US005564607A

United States Patent [19]

Miller et al.

[11] Patent Number: 5,564,607

[45] Date of Patent: Oct. 15, 1996

[54] SUPPLY CARTRIDGE FOR AN ELECTROSTATOGRAPHIC PRINTER OR COPIER

[75] Inventors: Daniel C. Miller, Fairport; Kevin L. Maltzahn, Webster, both of N.Y.; John D. Sundquist, Clarksville, Va.

[73] Assignee: Xerox Corporation, Stamford, Conn.

[21] Appl. No.: 444,170

[22] Filed: May 18, 1995

[51] Int. Cl.[6] ..... G03G 15/08

[52] U.S. Cl. ..... 222/325; 222/DIG. 1; 355/260

[58] Field of Search ..... 222/171, 216, 222/325, 556, DIG. 1; 141/364; 355/260

[56] References Cited

U.S. PATENT DOCUMENTS 4,937,628 6/1990 Cipolla et al. ..... 222/DIG. 1

5,506,665 4/1996 Ishida et al. ..... 222/DIG. 1

5,515,143 5/1996 Shiotani ..... 355/260

*Primary Examiner*—Kevin P. Shaver

*Assistant Examiner*—Philippe Dergkshani

*Attorney, Agent, or Firm*—R. Hutter

[57] ABSTRACT

A supply cartridge for a printer or copier retains a quantity of dry marking material. The cartridge defines a round structure on an exterior thereof, with a collar rotatable about the round structure. The round structure and the collar both define openings, and the cartridge can dispense marking material when the openings are aligned. A pad is attached to an inner surface of the collar to enhance urging of the collar against the opening of the cartridge when the cartridge is closed. The pad itself urges against the round structure at a point on the circumference of the round structure opposite the opening therein. Alternately, a protrusion can be provided in the round structure at a point opposite the opening.

15 Claims, 2 Drawing Sheets

SUPPLY CARTRIDGE FOR AN ELECTROSTATOGRAPHIC PRINTER OR COPIER

CROSS REFERENCE TO RELATED APPLICATIONS

Cross-reference is made to co-pending U.S. patent application Ser. No. 08/254,204, entitled "Container Coupling Member," assigned to the assignee hereof.

FIELD OF THE INVENTION

The present invention relates to a supply cartridge for the storage and dispensing of marking material, such as toner, for use in a printing or copying apparatus.

BACKGROUND OF THE INVENTION

In the well-known process of electrostatography or xerography, electrostatic latent images are created on a charge-retentive surface, either by direct exposure of a hard-copy original image or by digital means in response to image data. The electrostatic latent image is "developed" by general application of dry marking particles thereto. Typically, in such a development step, the marking particles are caused to adhere only to those areas on the latent image which are charged in a particular way. For example, depending on a specific design, the marking particles can be caused to adhere to relatively charged or discharged areas on the charge-retentive surface.

Many techniques for carrying out this development step are known in the art. The dry marking material which is used to develop the latent image is generally referred to as "toner." A number of development techniques require that toner particles be evenly mixed with a quantity of "carrier." Generally speaking, toner plus carrier equals "developer." Typically, toner particles are extremely fine, and responsive to electric fields; carrier particles, in contrast, are relatively large and respond to magnetic fields. In a "magnetic brush" development system, the developer is exposed to relatively strong magnetic fields, causing the carrier particles to form brush-like strands, much in the manner of iron filings exposed to a magnetic field. The toner particles, in turn, are triboelectrically adhered to the carrier particles in the strands. What is thus formed is a brush of magnetic particles with toner particles adhering to the strands of the brush. This brush can be brought in contact with the latent image, and under certain conditions the toner particles will separate from the carrier particles and adhere as necessary to the charge-retentive surface.

In commercially-available printers and copiers (as used in the specification and claims herein, a copier shall be considered a type of printer), it is well known that any individual printer periodically requires replenishment of its supply of developer or other marking material. It is typically desirable that such replenishment of a developer supply be performed by an end user, so that a service call by trained personnel is not necessary. Replenishment of developer, however, may present any number of inconveniences to a user. Toner material is typically in the form of a very fine powder which adheres easily to any surface, such as skin, which it may contact. Further, airborne toner particles can easily be inhaled by a user.

In order to overcome the inconveniences of manually replenishing a developer supply, it is typical to provide developer material in replacement cartridges, which can be readily "snapped in" to a printer or copier with minimal exposure of free toner particles to the outside. Co-pending U.S. Pat. application Ser. No. 08/254,204, assigned to the assignee hereof, generally discloses a developer supply replacement cartridge, which may be purchased at retail and installed in a copier or printer by a relatively unskilled end-user. The particular assembly disclosed in the application comprises two coupled containers, one intended to retain a supply of fresh developer material, and the other adapted to accept waste developer material from a dispenser forming part of the copier.

It is one object of the present invention to provide a supply cartridge for dispensing marking material in a printing apparatus such as a copier, which may be readily installed with minimal inconvenience by an end-user, and which is also of a low-cost design.

SUMMARY OF THE INVENTION

According to one aspect of the present invention, there is provided a supply cartridge for dispensing marking material in a printing apparatus. A chamber for retains a quantity of marking material. A round structure is defined by an external surface of the cartridge, the round structure defining a substantially circular circumference. A chamber opening is disposed at a first location along the circumference. A collar, defining a collar opening therein, is rotatable around the round structure, the collar being positionable to align the collar opening with the chamber opening. A compressible pad is disposed between the collar and the round structure at a second location along the circumference substantially opposite the chamber opening when the collar opening is not aligned with the chamber opening.

According to another aspect of the present invention, there is provided a supply cartridge for dispensing marking material in a printing apparatus. A chamber for retains a quantity of marking material. A round structure is defined by an external surface of the cartridge, the round structure defining a substantially circular circumference. A chamber opening is disposed at a first location along the circumference. A collar, defining a collar opening therein, is rotatable around the round structure, the collar being positionable to align the collar opening with the chamber opening. A protrusion is defined in the round structure at a location along the circumference substantially opposite the chamber opening.

DETAILED DESCRIPTION OF THE INVENTION

Figure 1:
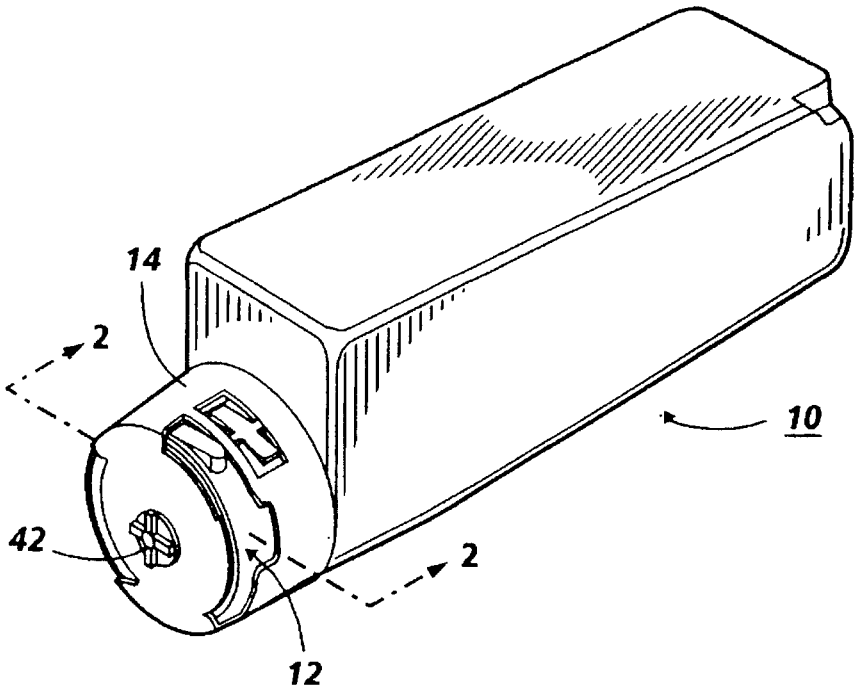
FIG. 1 is a perspective view showing the exterior of a supply cartridge according to the present invention.

FIG. 1 is a perspective view showing a supply cartridge according to the present invention. The body of the cartridge, generally labeled 10, is preferably in the form of a hollow bottle of substantially uniform thickness, and preferably made from a lightweight, recyclable material such as blow-molded plastic. When a consumer purchases the cartridge, the cartridge is typically pre-filled with a supply of developer, either in the form of pure toner or, for certain types of development systems, with a suitably optimized proportion of toner particles to carrier particles. It is the intention that the fresh supply of developer material be dispensed in a controlled manner into the development system of the xerographic printer or copier. According to the illustrated embodiment of the present invention, the cartridge 10 includes in an outer surface thereof what is referred to in the claims as a "round structure" indicated as 12 in FIG. 1, and which is here covered by a "collar" generally indicated as 14. It is the intention of the present invention that collar 14, forming a generally round or cylindrical shape on an inner surface thereof, is rotatably positionable around the outer surface of the round structure 12 which is defined as part of the cartridge 10. The round structure 12 can be in the general form of, for example, a cylinder or a cone; what is important is that it defines a generally circular external cross-section or circumference so the collar 14 may be rotatably positioned around it.

Figure 2:
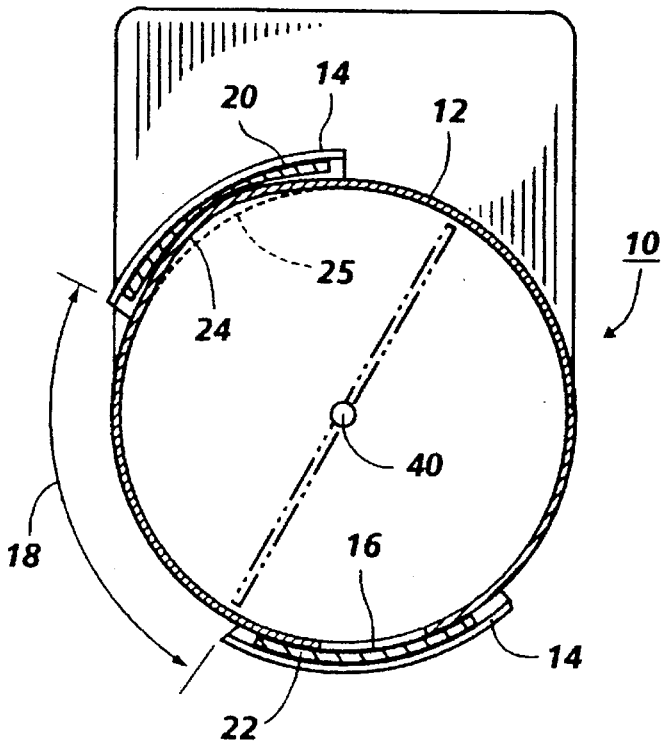
FIG. 2 is a cross-sectional view of a portion of the supply cartridge through line 2—2 of FIG. 1.

FIG. 2 is a cross-sectional view through the round structure 12 of cartridge 10, showing the operation of collar 14. It will be noted that the round structure 12 of cartridge 10 has defined therein a chamber opening 16, which permits the dispensing of developer material which would be contained in the chamber formed by cartridge 10 to, for example, the development housing of an electrophotographic printer or copier.

Collar 14 is intended to be rotatably positionable around the circumference formed by round structure 12. As can be seen in FIG. 2, the collar 14 is so configured that when collar 14 is in a particular position, a portion of collar 14 can be used to obstruct chamber opening 16 so that no marking material will spill from the interior of the chamber formed by cartridge 10. Placing the collar 14 in the position illustrated in the FIG. 2 thus represents the "closed" position, in which the cartridge 10 may be conveniently and safely handled by a human user. When collar 14 is rotated relative to round structure 12 in approximately a quarter-turn in a counterclockwise direction as shown in FIG. 2, a collar opening, here indicated as 18, can be made to align with chamber opening 16. This alignment permits the dispensing of toner or other marking particles through chamber opening 16 and collar opening 18, and into the development unit of a printer or copier.

To prevent accidental spilling of marking particles from cartridge 10 while it is being handled, collar 14 includes a number of features which, together or separately, contribute to proper sealing of the chamber opening 16. Disposed on inner-facing surfaces of collar 14, generally intended to contact the outer surface of round structure 12, are compressible pad 20 and sealing pad 22. These compressible pads can comprise, for example, foam rubber covered with a relatively low-friction substance, or any other suitable compressible material. As shown in FIG. 2, when collar 14 is in such a position that chamber opening 16 is obstructed, sealing pad 22 is in such a position as to urge against the edges formed by chamber opening 16. This urging of sealing pad 22 against the area around chamber opening 16 forms a suitable and sufficient seal over chamber opening 16, so that, when the cartridge 10 is being handled, little or no marking material will escape from the interior of the cartridge.

In order to obtain a sufficiently firm seal by sealing pad 22 around opening 16, it is desirable that sealing pad 22 be slightly urged against the side of round structure 12. The preferred embodiment of the invention includes a compressible pad 20 which is disposed on an inner surface of collar 14 substantially opposite (that is, including a point 180 degrees around the circumference of round structure 12 from) sealing pad 22. This pad 20 is used not to directly form a seal against any portion of round structure 12, but rather to provide a degree of compressive force against a surface of round structure 12 opposite chamber opening 16. As shown by the configuration of pads 20 and 22 in FIG. 2, the compressive force of pad 20 against its particular portion of the circumference of the outer surface of round structure 12 pushes that portion of collar 14 to the upper left in FIG. 2; this pressure toward the upper left is also applied by the portion of collar 14 adjacent chamber opening 16. Therefore, pad 20 contributes to the urging pressure of sealing pad 22 against the portion of the circumference of round structure 12 against chamber opening 16, thereby increasing the pressure of sealing pad 22 against opening 16, and enhancing the seal of sealing pad 22 against chamber opening 16.

Round structure 12 may further include a protuberance or protrusion, here indicated as 24, which presses into compressible pad 20 when collar 14 is in the illustrated closed position. As illustrated in FIG. 2, this protrusion 24 is in the form of a slight distortion of the shape of round structure 12 relative to a perfect circle as indicated by the dotted lines marked 25. Protrusion 24 further increases the urging against collar 14 on the side thereof opposite chamber opening 16, enhancing the seal of sealing pad 22 against chamber opening 16. Another possible form for protrusion 24 may be a groove or convex dimple formed in the outer surface of round structure 12 along the portion of the circumference thereof opposite chamber opening 16.

In the preferred embodiment of the present invention illustrated in FIG. 2, both pads 20 and 22 are attached, such as by means of an adhesive, firmly to the interior surface of collar 14. One possible variation to the illustrated embodiment would be to attach compressible pad 20 not to collar 14, but rather to the outer surface of round structure 12. Also, it is conceivable to leave out one of either compressible pad 20 or protuberance 24, and still retain some effect of enhancing the urging of sealing pad 22 against opening 16.

Cartridge 10 may further include on the interior thereof an agitator 40, an axle of which is shown in solid in FIG. 2, with vanes thereof shown in phantom; the vanes extend through the body of cartridge 10. When the axle 40 is rotated, the vanes of the agitator distribute marking materials within the interior of chamber 10 so that the particles will be evenly dispensed through the chamber opening 16. The agitator 40 is typically caused to rotate by external means within the printer. In FIG. 1 can be seen a toothed hub 42, which in this embodiment is rigidly attached to the agitator 40. Toothed hub 42 is engaged by a gear within the printer to rotate the agitator 40 within cartridge 10.

Figure 3:
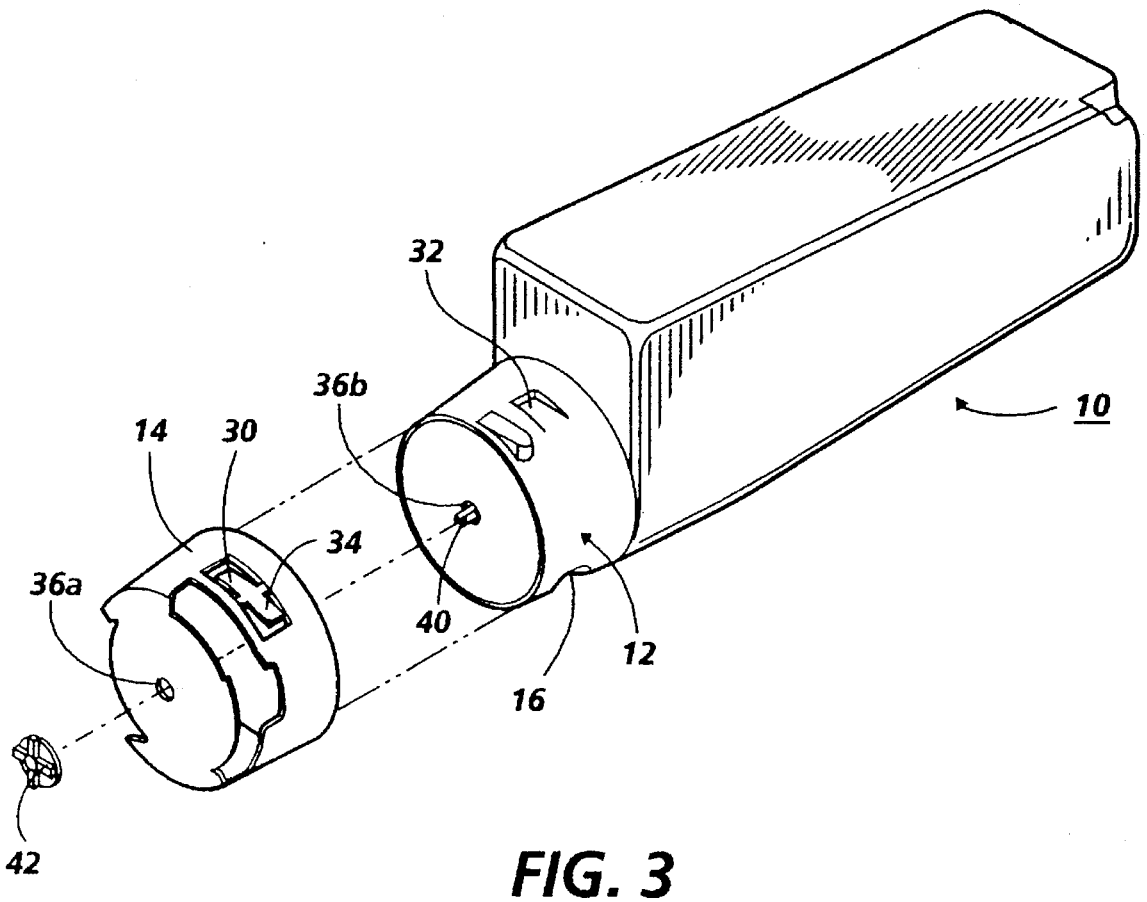
FIG. 3 is an exploded view showing the collar and round structure of the supply cartridge.

FIG. 3 is a perspective view in detail of round structure 12, with collar 14 separated therefrom, showing further enhancements to the cartridge of the present invention. Collar 14 further includes a lock lever 30, which engages an indentation 32 in a portion of round structure 12. By pressing down on portion 34 of lock lever 30, lock lever 30 is pulled out of indentation 32, thereby allowing relatively free rotation of collar 14 about round structure 12. In the usual condition, however, one side of lock lever 30 is springably urged against indentation 32 (such as by the natural spring property of the plastic of collar 14), preventing the accidental rotation of collar 14.

As illustrated, collar 14 is configured to form an "end cap" generally covering the cylinder-end formed by round structure 12. The concentric axle openings **36*a* and 36*b* of the end cap formed by collar 14 and round structure 12 respectively can be used as through-holes for the rotatable agitator 40 disposed within the chamber formed by cartridge 10. As shown in FIG. 3, toothed hub 42, which is attached to the axle of agitator 40, can serve to hold collar 14 on the cartridge 10. For a compact design, it is preferable to make the axis of rotation of collar 14 about round structure 12 concentric with the axle of agitator 40**.

While the invention has been described with reference to the structure disclosed, it is not confined to the details set forth, but is intended to cover such modifications or changes as may come within the scope of the following claims.

We claim:

1. A supply cartridge for dispensing marking material in a printing apparatus, comprising:

a chamber for retaining a quantity of marking material;

a round structure defined by an external surface of the cartridge, the round structure defining a substantially circular circumference; a chamber opening disposed at a first location along the circumference of the round structure;

a collar defining a collar opening therein, the collar being rotatable around the round structure, the collar being positionable to align the collar opening with the chamber opening; and a compressible pad, disposed between the collar and the round structure at a second location approximately 180 degrees along the circumference relative to the chamber opening when the collar opening is not aligned with the chamber opening.

2. The cartridge of claim 1, the compressible pad being attached to an inner surface of the collar.

3. The cartridge of claim 1, wherein the compressible pad causes an inner surface of the collar to urge against the chamber opening when the collar opening is not aligned with the chamber opening.

4. The cartridge of claim 1, further comprising a protrusion defined in the round structure at the second location.

5. The cartridge of claim 1, further comprising a sealing pad, attached at a fixed location on an inner surface of the collar, the fixed location corresponding to the chamber opening when the compressible pad is disposed at the second location.

6. The cartridge of claim 1, further comprising an agitator rotatably mounted within the chamber, the agitator having an axis of rotation concentric with an axis of rotation of the collar about the round structure.

7. The cartridge of claim 6, the agitator including an axle, and the collar forming an end cap generally over the round structure, the end cap including a through-hole and the axle extending through the through-hole.

8. A supply cartridge for dispensing marking material in a printing apparatus, comprising:

a chamber for retaining a quantity of marking material;

a round structure defined by an external surface of the cartridge, the round structure defining a substantially circular circumference;

a chamber opening disposed at a first location along the circumference of the round structure;

a collar defining a collar opening therein, the collar being rotatable around the round structure, the collar being positionable to align the collar opening with the chamber opening; and a protrusion defined in the round structure at a second location approximately 180 degrees along the circumference relative to the chamber opening, the protrusion urging against an inner-facing surface of the collar when the collar opening is positioned to be not aligned with the chamber opening.

9. A supply cartridge for dispensing marking material in a printing apparatus, comprising:

a chamber for retaining a quantity of marking material;

a round structure defined by an external surface of the cartridge, the round structure defining a substantially circular circumference;

a chamber opening disposed at a first location along the circumference of the round structure;

a collar defining a collar opening therein, the collar being rotatable around the round structure, the collar being positionable to align the collar opening with the chamber opening; and a protrusion defined in the round structure at at a second location along the circumference substantially opposite the chamber opening; and a compressible pad, disposed between the collar and the round structure at the second location when the collar opening is not aligned with the chamber opening.

10. The cartridge of claim 9, the compressible pad being attached to an inner surface of the collar.

11. The cartridge of claim 9, further comprising a sealing pad, attached at a fixed location on an inner surface of the collar, the fixed location corresponding to the chamber opening when the collar opening is not aligned with the chamber opening.

12. The cartridge of claim 8, further comprising an agitator rotatably mounted within the chamber, the agitator having an axis of rotation concentric with an axis of rotation of the collar about the round structure.

13. The cartridge of claim 12, the agitator including an axle, and the collar forming an end cap generally over the round structure, the end cap including a through-hole and the axle extending through the through-hole.

14. A supply cartridge for dispensing marking material in a printing apparatus, comprising:

a chamber for retaining a quantity of marking material;

a round structure defined by an external surface of the cartridge, the round structure defining a substantially circular circumference;

a chamber opening disposed at a first location along the circumference of the round structure;

a collar defining a collar opening therein, the collar being rotatable around the round structure, the collar being positionable to align the collar opening with the chamber opening;

a compressible pad, attached to an inner surface of the collar, disposed between the collar and the round structure at a second location approximately 180 degrees along the circumference relative to the chamber opening when the collar opening is not aligned with the chamber opening;

a protrusion defined in the round structure at a second location approximately 180 degrees along the circumference relative to the chamber opening; and a sealing pad, attached at a fixed location on an inner surface of the collar, the fixed location corresponding to the chamber opening when the collar opening is not aligned with the chamber opening.

15. The cartridge of claim 14, further comprising an agitator rotatably mounted within the chamber, the agitator having an axis of rotation concentric with an axis of rotation of the collar about the round structure.

* * * * *